US005660678A

United States Patent [19]

Parker, Jr.

[11] Patent Number: 5,660,678

[45] Date of Patent: Aug. 26, 1997

[54] HAND-HELD EDGE BANDING MACHINE

[76] Inventor: Francis X. Parker, Jr., 3803 Gulfview Driver, Newark, Del. 19702

[21] Appl. No.: 617,554

[22] Filed: Mar. 19, 1996

[51] Int. Cl.[6] ..... B32B 31/00

[52] U.S. Cl. ..... 156/577; 156/522; 156/523; 156/579; 156/259

[58] Field of Search ..... 156/524, 525, 156/575, 577, 578, 579, 574, 523, 259, 522, 391

[56] References Cited

U.S. PATENT DOCUMENTS

| | | | |
|---|---|---|---|
| 3,707,427 | 12/1972 | Erickson | 156/575 |
| 3,935,758 | 2/1976 | Polzin et al. | 156/391 |
| 4,357,198 | 11/1982 | Ezquerro | 156/577 X |
| 4,358,337 | 11/1982 | Johnson et al. | 156/579 X |
| 4,707,202 | 11/1987 | Sweeny | 156/579 X |

*Primary Examiner*—James Engel

[57] ABSTRACT

A hand-held edge banding machine including a dispensing gun that has a handle with a front extent and a trigger mechanism. The front extent has a top surface and a pair of side panels. The handle has a top portion with a spool clamp projecting upwardly. A cutter is coupled to the front extent of the gun by a cable that is positioned underneath the front extent. The cable is coupled to the trigger mechanism. A housing is attached to the top surface of the front extent. The housing has a front wall and a pair of side walls with each wall having a channel. A pair of trim blades are extended through a top surface of the housing, with one of each blade coupled to a pivot pin. The pivot pin is positioned through the pair of side walls. Lastly, a spool of edge binding tape is supported by a spool support arm of the handle. A portion of the tape is continuously feed through the housing for attaching to a receiving surface. The tape is cut from the gun by the cutter.

9 Claims, 3 Drawing Sheets

FIG 3
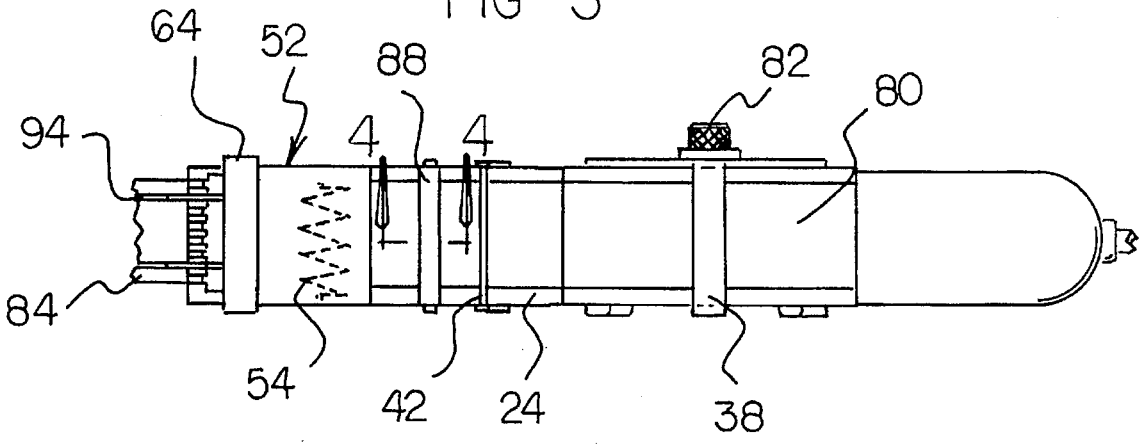
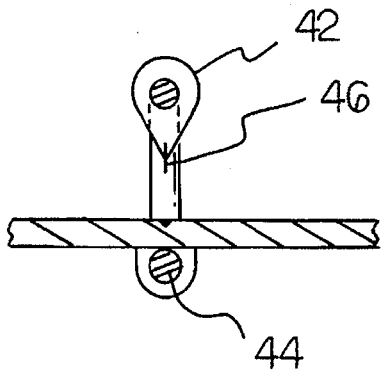
FIG 4

FIG 6
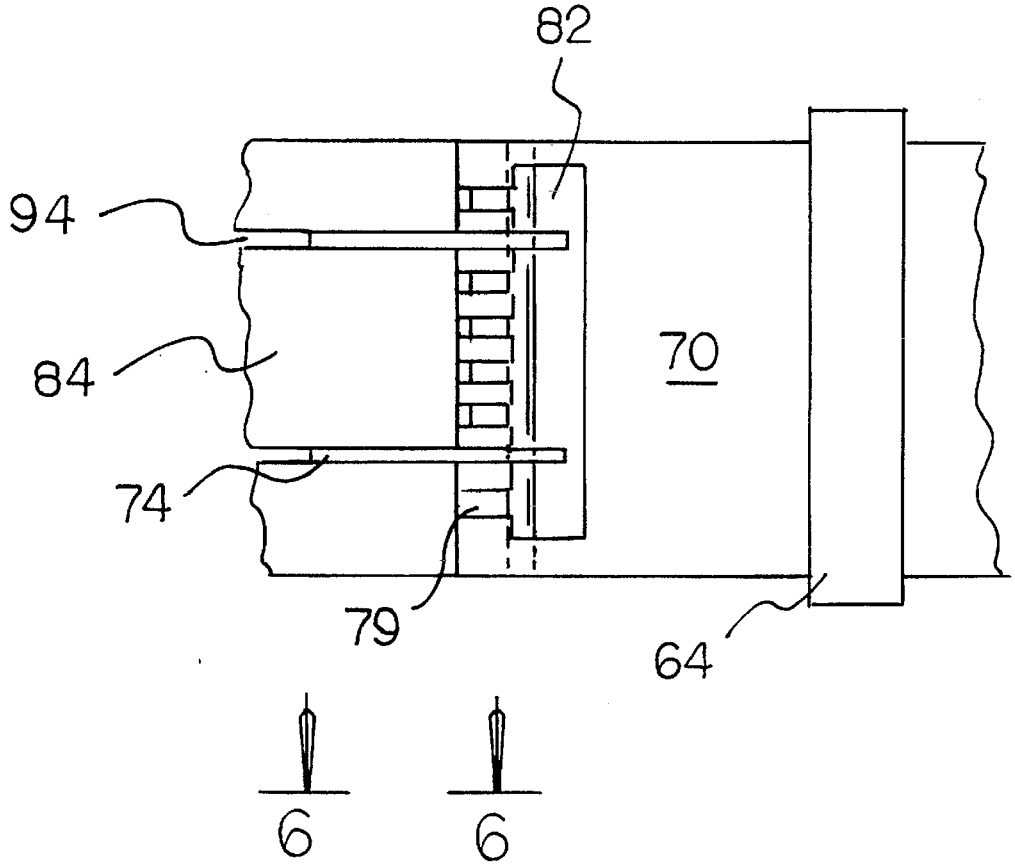
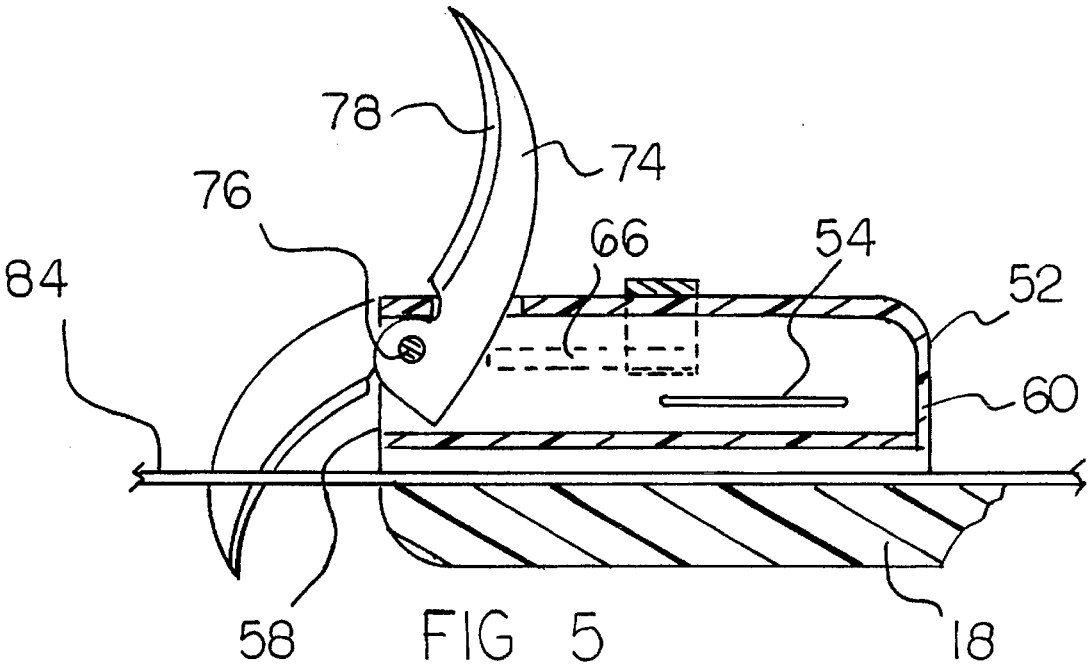
FIG 5

HAND-HELD EDGE BANDING MACHINE

BACKGROUND OF THE INVENTION

1. Field of the Invention

The present invention relates to a hand-held edge banding machine and more particularly pertains to providing a gun dispensing means for edge banding tape that allows a continuous length of tape and adhesive to be positioned against a receiving surface, and further providing trim blades to trim the tape automatically for the needed width.

2. Description of the Prior Art

The use of tape dispensers is known in the prior art. More specifically, the use of tape dispensers heretofore devised and utilized for the purpose of dispensing rolls of adhesive tape are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,350,099 to Kienzle discloses a dispenser for package sealing tape. U.S. Pat. No. 5,283,117 to Arai, Oki, Maemura and Funaki discloses a laminate and seal-adhesive tapes. U.S. Pat. No. 5,236,269 to Handy discloses a battery-powered dispenser for hot melt adhesive. U.S. Pat. No. 4,303,108 to Akers, Scholl, Smith and Williams discloses a hot melt adhesive dispensing system of the hand-held gun type. U.S. Pat. No. 3,707,427 to Erickson discloses a dispensing gun for wallboard tape and joint compound. Lastly, U.S. Pat. No. 3,459,335 to Cohen and Blivice discloses a manual dispenser for heated adhesive.

While these devices fulfill their respective, particular objectives and requirements, the aforementioned patents do not describe hand-held edge banding machine that allows a continuous length of edge banding tape with adhesive to be dispensed from a banding tape machine whereby, the edge banding tape is trimmed upon application automatically.

In this respect, the hand-held edge banding machine according to the present invention substantially departs from the conventional concepts and designs of the prior art, and in doing so provides an apparatus primarily developed for the purpose of providing a gun dispensing means for edge banding tape that allows a continuous length of tape and adhesive to be positioned against a receiving surface, and further providing trim blades to trim the tape automatically for the needed width.

Therefore, it can be appreciated that there exists a continuing need for a new and improved hand-held edge banding machine which can be used for providing a gun dispensing means for edge banding tape that allows a continuous length of tape and adhesive to be positioned against a receiving surface, and further providing trim blades to trim the tape automatically for the needed width. In this regard, the present invention substantially fulfills this need.

SUMMARY OF THE INVENTION

In view of the foregoing disadvantages inherent in the known types of tape dispensers now present in the prior art, the present invention provides an improved hand-held edge banding machine. As such, the general purpose of the present invention, which will be described subsequently in greater detail, is to provide a new and improved hand-held edge banding machine and method which has all the advantages of the prior art and none of the disadvantages.

To attain this, the present invention essentially comprises a dispensing gun that has a handle with an elongated front extent extending from a front portion of the handle. The handle of the gun has a trigger mechanism. The front extent has a planar top surface and a pair of side panels. The handle has a power cord extending from a bottom portion. Included is a spool support arm projecting upwardly from a top portion of the handle. The spool support arm has a pin wheel with at least three vanes. Each vane has a spool clamp. Also, a cutter is positioned above the front extent of the gun by a cable. The cable is positioned underneath the front extent. The cable is engagingly coupled to the trigger mechanism of the gun. The cutter may be moved toward the top surface the front extent when the trigger mechanism is squeezed. A generally rectangular housing is fixedly attached to the top surface of the front extent. The housing has a heating element within that is powered by the power cord. The housing has a front wall, a rear wall and a pair of side walls. The housing has a locking bar that is capable of traversing a channel in each side wall. The channel of each side wall is capable of allowing the locking bar to move back and forth across the top surface of the housing. A pair of trim blades are provided. One of each blade is rotatably coupled to a pivot pin that is positioned through the pair of side walls of the housing. Each trim blade extends through a duct within the top surface of the housing, and near the front wall. The pair of trim blades have a variable gap width therebetween. The gap width is adjustable as each trim blade is moved inwardly and outwardly along the pivot pin. The pair of trim blades are rotatable downwardly. Lastly, a spool of edge banding tape is positioned within the wheel of the spool support arm. The spool of tape is lockingly positioned within each spool clamp of the pin wheel. The pin wheel is locked in position by a spool release. The spool of tape is rotated within the spool support arm when the spool release is unlocked. The spool of tape has a portion that is fed through the housing and attached to a receiving surface. Furthermore, the front extent of the gun is moved along the receiving surface while the portion of tape is continuously fed through the housing. The portion of tape attaches to the receiving surface along a continuous length. The tape has a width that is decreased by the pair of trim blades as the tape is fed through the housing. The tape is cut away from the gun by the cutter being pressed against the tape when the trigger of the gun is pulled.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hand-held edge banding machine which has all of the advantages of the prior art tape dispensers and none of the disadvantages.

It is another object of the present invention to provide a new and improved hand-held edge banding machine which may be easily and efficiently manufactured and marketed.

It is further object of the present invention to provide a new and improved hand-held edge banding machine which is of durable and reliable constructions.

An even further object of the present invention is to provide a new and improved hand-held edge banding machine which is susceptible of a low cost of manufacture with regard to both materials and labor, and which accordingly is then susceptible of low prices of sale to the consuming public, thereby making such hand-held edge banding machine economically available to the buying public.

Still yet another object of the present invention is to provide a new and improved hand-held edge banding machine which provides in the apparatuses and methods of the prior art some of the advantages thereof, while simultaneously overcoming some of the disadvantages normally associated therewith.

Even still another object of the present invention is to provide a hand-held edge banding machine for providing a gun dispensing means for edge banding tape that allows a continuous length of tape and adhesive to be positioned against a receiving surface, and further providing trim blades to trim the tape automatically for the needed width.

Lastly, it is an object of the present invention to provide a new and improved hand-held edge banding machine including a dispensing gun that has a handle with a front extent and a trigger mechanism. The front extent has a top surface and a pair of side panels. The handle has a top portion with a spool support arm projecting upwardly therefrom. A cutter is coupled to the front extent of the gun by a cable. The cable is positioned underneath the front extent and is engagingly coupled to the trigger mechanism. A housing is fixedly attached to the top surface of the front extent. The housing has a front wall and a pair of side walls with each wall having a channel. A pair of trim blades are extended through a top surface of the housing, with one of each blade coupled to a pivot pin. The pivot pin is positioned through the pair of side walls. Lastly, a spool of edge binding tape is positioned within the spool support arm of the housing. A portion of the tape is fed through the housing and a tape feed for attaching to a receiving surface. The tape is continuously feed through the housing and attaches to the receiving surface and is cut away from the gun by the cutter.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top plan view of the present invention in an operable configuration.

FIG. 4 is a fragmentary sectional view of the cutter taken along line 4—4 of FIG. 3.

FIG. 5 is a cross sectional view of the housing of the present invention.

FIG. 6 is a top fragmentary view of the present invention taken along line 6—6 of FIG. 5.

The same reference numerals refer to the same parts through the various Figures.

DESCRIPTION OF THE PREFERRED EMBODIMENT

Figure 1:
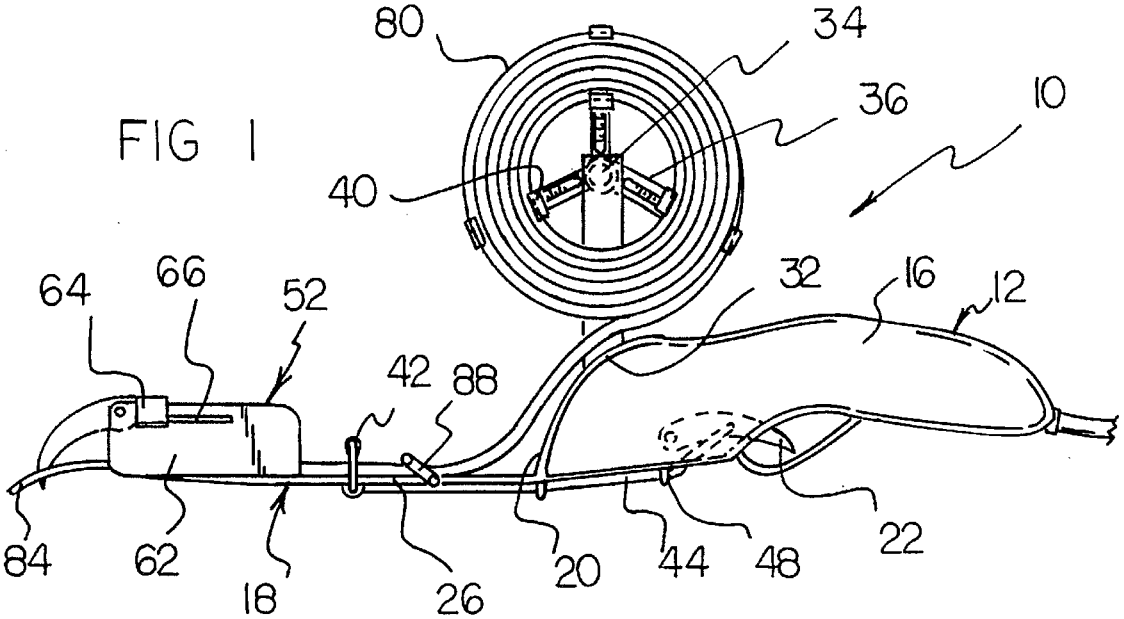
FIG. 1 is a perspective view of the preferred embodiment of the hand-held edge banding machine constructed in accordance with the principles of the present invention.

With reference now to the drawings, and in particular to FIG. 1 thereof, the preferred embodiment of the new and improved hand-held edge banding machine embodying the principles and concepts of the present invention and generally designated by the reference numeral 10 will be described.

The present invention, the hand-held edge banding machine 10 is comprised of a plurality of components. Such components in their broadest context include a dispensing gun, a cutter, trim blades and a spool of edge banding tape. Such components are individually configured and correlated with respect to each other so as to attain the desired objective.

Figure 2:
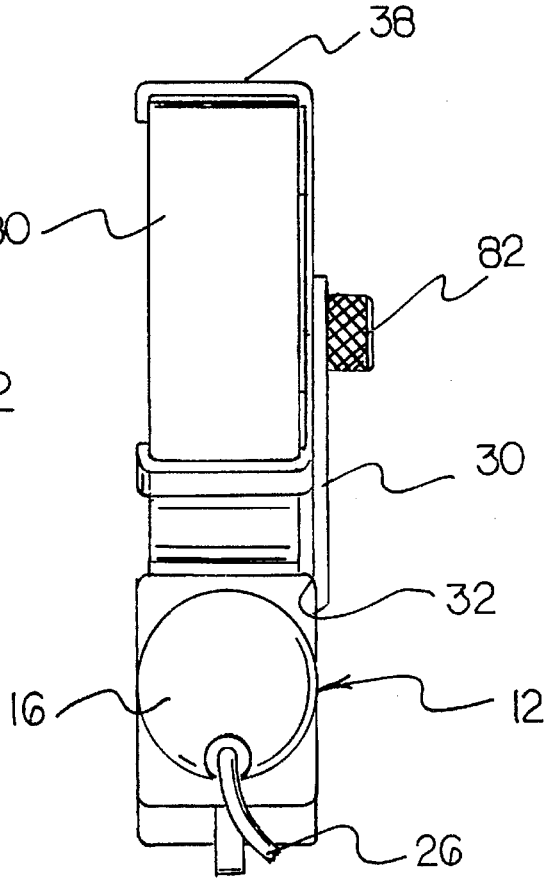
FIG. 2 is a rear elevational view of the present invention of FIG. 1.

Specifically, the present invention includes a dispensing gun 12 as seen in FIG. 1. The gun has a handle 16 with an elongated front extent 18 that extends from a front portion 20 of the handle. The handle of the gun has a trigger mechanism 22. The front extent has a planar top surface 24 and a pair of side panels 26. The top surface of the front extent is shown in FIG. 3. The handle, as shown in FIG. 2, has a power cord 26 that extends from the bottom portion. The handle is made of a rigid plastic that is light weight. The handle and the front extent are both in a horizontal orientation.

As best illustrated in FIG. 2, a spool support arm 30 extends from a top portion 32 of the handle 16. The spool support arm extends upwardly from the handle and has a pin wheel 34 positioned through the top end. The pin wheel has at least three vanes 36. Each vane, as seen in FIG. 2, has a spool clamp 38. Each spool clamp, as shown in FIG. 1, has an interior gripping element 40. Each interior gripping element moves up and down the length of the respective vane. The movement of the gripping element allows tape spools of various diameter to be secured about the pin wheel. Each spool clamp is about two inches wide.

Also, a cutter 42 is positioned above the front extent 18 of the gun by a cable 44. The cable, as seen in FIG. 1, is positioned underneath the front extent. The cutter is made of a metal or metal alloy and has a tapered edge 46, as seen in FIG. 4. The cable is a metallic material that is engagingly coupled to the trigger mechanism 22 of the gun. The cable passes from the trigger mechanism to extend along the front extent. The cable is supported on underneath the front extent by a plurality of brackets 48. The cutter is moved toward the front extent when the trigger mechanism is squeezed and pulls the cable.

A generally rectangular housing 52 is fixedly attached to the top surface 24 of the front extent. The housing has a heating element 54 within, as seen in FIGS. 3, that is powered by the power cord. The housing is made of an identical plastic used to make the gun. The housing has a front wall 58, a rear wall 60 and a pair of side walls 62. The housing has a locking bar 64 that is capable of traversing a channel 66 of each side wall. The locking bar is plastic or metal, which ever will slide frictionlessly within the channel of each side wall. The channel of each side wall allows the locking bar to move back and forth across a top surface 70 of the housing.

As best illustrated in FIG. 5, a pair of trim blades 74 are provided. One of each blade is rotatably coupled to a pivot pin 76 that is positioned through the pair of side walls 62 of the housing 52. Each trim blade is formed of metal, preferably stainless steel. Each trim blade has a blade edge 78, as shown in FIG. 5. Each trim blade extends through a duct 82 within the top surface 70 of the housing, and near the front wall 58. The pair of trim blades have a variable gap width between the pair of blades. The gap width can be adjusted in one sixteenth increments leaving the gap width between one half and one and a half inches. The gap width is adjustable as each trim blade is moved inwardly and outwardly, in reference to each other, along the pivot pin 76. The pair of trim blades are capable of rotating downwardly and upwardly. When the pair of trim blades are rotated downwardly they are positionable through any two slots of a plurality of slots 79 of the housing. The slots are proportionately spaced where the top surface and front wall of the housing connect. Each slot is spaced thereon in increments of one sixteenth of an inch.

Additionally, a spool of edge banding tape 80 is included. The spool of tape is positioned within the pin wheel 34 of the spool support arm. The spool of tape is lockingly positioned within each spool clamp 38 of the pin wheel. The pin wheel is locked in position on the spool support arm by a spool release 82, as seen in FIG. 2. The spool of tape may be rotated within the spool support arm, and about the pin wheel, when the spool release is unlocked. The spool of tape has a portion of tape 84 that is fed through a tape guide 88 and the housing 52 for attaching to a receiving surface. When the tape is fed through the housing an adhesive on the tape is heated by the heating element to ensure that the tape attaches to the receiving surface.

Lastly, the front extent of the gun is moved along the receiving surface. As the gun is moved the portion of tape 84 is continuously fed along the top surface of the front extent and through the housing. As the gun is moved over the receiving surface the tape extends for a continuous length and is attached to the receiving surface. The tape has a width that is capable of being decreased by the pair of trim blades, as seen in FIG. 3 at 94, as the tape is being fed through the housing. The tape is capable of being cut away from the gun 12 when the trigger is pulled and causes the cutter 38 to press against the tape and the top surface 24 of the front extent 18.

The present invention provides an easy to use hand-held edge banding machine for applying banding tape. The present invention is comprised of a dispensing gun that has a spool of edge banding tape coupled to a top portion. The tape is pre-glued prior to being placed in a spool form. The tape is threaded through the housing where the adhesive is heated prior to allowing the tape to be attached to a receiving surface.

The width of the tape can be automatically adjusted as the edge banding tape is being attached to the receiving surface. The tape is trimmed by a pair of trimmers that are attached to the housing. As the tape is dispensed, the trimmers are locked in position by a locking bar and automatically trim the tape to have a width anywhere from one and a half inch to a half of an inch.

The present invention is quick and very easy to use. The present invention reduces the amount of time needed to place edge banding tape on a receiving surface. Through the use of the present invention the user will not have to go back and trim the tape after applying it.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A hand-held edge banding machine for applying edge banding tape to various surfaces comprising in combination:

a dispensing gun having a handle with an elongated front extent extending from a top portion of the handle, the handle of the gun having a trigger mechanism, the front extent having a planar top surface and a pair of side panels, the handle having a power cord extending from a bottom portion;

a spool support arm projecting upwardly from a top portion of the handle, the spool support arm having a pin wheel with at least three vanes, each vane having a spool clamp;

a cutter being positioned above the front extent of the gun by a cable positionable underneath the front extent, the cable being engagingly coupled to the trigger mechanism of the gun, the cutter capable of being moved toward the top surface of the front extent when the trigger mechanism is squeezed;

a generally rectangular housing being fixedly attached to the top surface of the front extent, the housing having a heating element therein capable of being powered by the power cord, the housing having a front wall, a rear wall and a pair of side walls therebetween, the housing having a locking bar capable traversing a channel of each side wall, the channel of each side wall being capable of allowing the locking bar to move back and forth across a top surface of the housing;

a pair of trim blades with one of each blade being rotatably coupled to a pivot pin positioned through the pair of side walls of the housing, each trim blade extending through a duct within the top surface of the housing and near the front wall, the pair of trim blades having a variable gap width therebetween, the gap width being adjustable as each trim blade being moved inwardly and outwardly along the pivot pin, the pair of trim blades being capable of rotating downwardly, the trim blades capable of being positioned through any two slots of a plurality of slots of the housing;

a spool of edge banding tape capable of being positioned within the pin wheel of the spool support arm, the spool of tape being lockingly positioned within each spool clamp by a spool release, the spool of tape being capable of rotating within the spool support arm, and about the pin wheel, when the spool release being unlocked, the spool of tape being capable of having a portion thereof being fed through the housing for attaching to a receiving surface; and the front extent of the gun capable of being moved along the receiving surface while the portion of tape being continuously fed through the housing for attaching to the receiving surface, the tape having a width capable of being decreased by the pair of trim blades as the tape being fed through the housing, the tape capable of being cut away from the gun by the cutter being pressed against the tape and the top surface of the front extent by pulling the trigger of the gun.

2. A hand-held edge banding machine comprising:

a dispensing gun having a handle with a front extent and a trigger mechanism, the front extent having a top surface and a pair of side panels, the handle having a top portion with a spool support arm projecting upwardly therefrom;

a cutter being coupled to the front extent of the gun by a cable positionable underneath the front extent and engagingly coupled to the trigger mechanism;

a housing being fixedly attached to the top surface of the front extent and having a front wall and a pair of side walls with each wall having a channel;

a pair of trim blades extending through a top surface of the housing with one of each blade being coupled to a pivot pin positioned through the pair of side walls of the housing; and a spool of edge banding tape capable of being supported by a spool support arm of the handle with a portion thereof being fed through the housing for attaching to a receiving surface, the tape being continuously fed through the housing for attaching to the receiving surface, and the tape being capable of being cut away from the gun by the cutter.

3. The hand-held edge banding machine as set forth in claim 2 wherein the front extent being elongated and extending from a front portion of the handle, the handle of the gun and the front extent being in a horizontal orientation thereof, and the handle having a power cord extending from a bottom portion thereof.

4. The hand-held edge banding machine as set forth in claim 2 wherein the cable being supported by a plurality of brackets positioned underneath the front extent, and the cable being capable moving the cutter toward the top surface of the front extent when the trigger mechanism being squeezed.

5. The hand-held edge banding machine as set forth in claim 3 wherein the power cord being attached to a heating element being positioned within the housing, the heating element being capable of warming the tap for better adhesion to the receiving surface.

6. The hand-held edge banding machine as set forth in claim 2 wherein the housing having a rigid locking bar capable traversing the channel of each side wall, the channel of each side wall allows the locking bar to move back and forth across the top surface of the housing for locking the pair of trim blades in any position.

7. The hand-held edge banding machine as set forth in claim 6 wherein the trim blades being rotatably coupled and extending through a duct within the top surface of the housing and near the front wall, the pair of trim blades having a variable gap width therebetween, the gap width being adjustable as each trim blade being moved inwardly and outwardly along the pivot pin.

8. The hand-held edge banding machine as set forth in claim 2 wherein the spool of tape being supported within the spool support arm by a pin wheel with at least three vanes, each vane having a spool clamp, and the pin wheel being locked within the spool support arm by a spool release, the spool of tape being capable of rotating about the pin wheel when the spool release being unlocked, and the tape having a width capable of being decreased by the pair of trim blades.

9. The hand-held edge banding machine as set forth in claim 8 wherein the front extent of the gun capable of being moved along the receiving surface while the portion of tape being fed through the housing for attaching to the receiving surface, and the tape being severed form the gun by the cutter.

* * * * *